US005418992A

United States Patent [19]

Alten

[11] Patent Number: 5,418,992

[45] Date of Patent: May 30, 1995

[54] SUPPORT PLATE FOR BRIDGES AND RAMPS

[76] Inventor: Kurt Alten, Ringstr. 14, D-30974, Wennigsen, Germany

[21] Appl. No.: 169,379

[22] Filed: Dec. 17, 1993

[30] Foreign Application Priority Data

Dec. 17, 1992 [DE] Germany ..... 42 42 746.0

[51] Int. Cl.[6] ..... E01D 19/12

[52] U.S. Cl. ..... 14/69.5; 14/73; 52/578; 404/34

[58] Field of Search ..... 14/2.4, 69.5, 71.1, 14/71.3, 73, 74.5, 77.3; 52/87, 731.2, 732.1, 732.2, 731.3, 570, 571, 572, 578, 580; 160/236; 404/34, 40, 43, 51; 405/219, 221; 114/263

[56] References Cited

U.S. PATENT DOCUMENTS

| | | | |
|---|---|---|---|
| 1,344,895 | 6/1920 | Irons | 404/34 |
| 2,033,751 | 3/1936 | Yeager | 52/731.2 X |
| 2,343,833 | 3/1944 | Pinson | 14/69.5 X |
| 3,253,288 | 5/1966 | Nagin | 14/73 |
| 3,712,187 | 1/1973 | Stelling | 404/34 X |

FOREIGN PATENT DOCUMENTS

| | | | |
|---|---|---|---|
| 7803283 | 7/1978 | Germany . | |
| 786240 | 11/1957 | United Kingdom | 14/73 |

*Primary Examiner*—Ramon S. Britts
*Assistant Examiner*—James A. Lisehora
*Attorney, Agent, or Firm*—Robert W. Becker & Associates

[57] ABSTRACT

A support plate for a bridge or ramp with a drive lane has two longitudinal supports forming lateral sides of the support plate. A plurality of transverse members is arranged parallel to one another and connected between the two longitudinal supports. The transverse members have an upper surface forming the drive lane. The transverse members are hollow and have a quadrangular cross-section. The transverse members have a first and a second sidewall, whereby the second sidewalls face the first sidewalls of neighboring ones of the transverse members. At least one angle member is connected to each second sidewall, the angle member having a first leg and a second leg. The first leg rests at an is fixedly connected to the second sidewall and the second leg projects laterally from the second sidewall for supporting the neighboring transverse member.

13 Claims, 1 Drawing Sheet

SUPPORT PLATE FOR BRIDGES AND RAMPS

BACKGROUND OF THE INVENTION

The present invention relates to a support plate for bridges and ramps having a drive lane, the support plate having two longitudinal supports on both sides that are connected to one another by a plurality of transverse members extending parallel to one another and having a rectangular or square hollow cross-section, wherein sidewalls of the transverse members facing one another are connected.

Based on the knowledge that a good sidewall connection of the transverse members results in a favorable load distribution over a plurality of transverse members and thus in a greater load capacity, it is an object of the present invention to provide a support plate of the aforementioned kind such that the connection between the sidewalls is achieved with little technical expenditure and that, furthermore, it is possible to assemble the support plate by simply placing the transverse members adjacent to one another without the need for additional connecting means.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
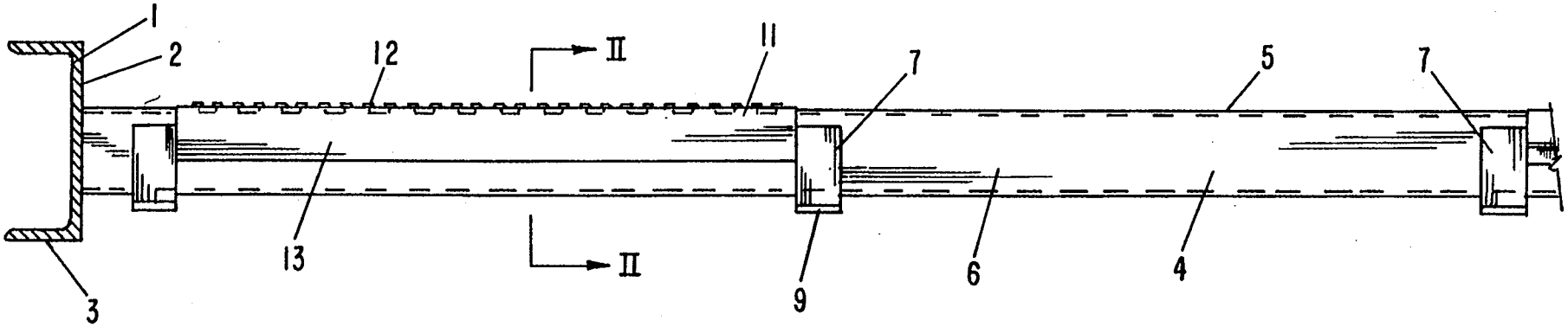
FIG. 1 shows a portion of a support plate in section for a stationary or movable slanted or horizontal ramp.
Figure 3:
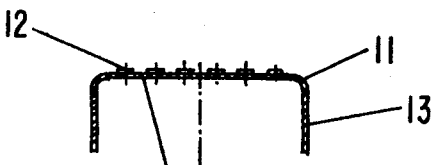
FIG. 3 shows a U-shaped transverse element for increasing the slip-resistance in a cross-sectional view.
Figure 4:
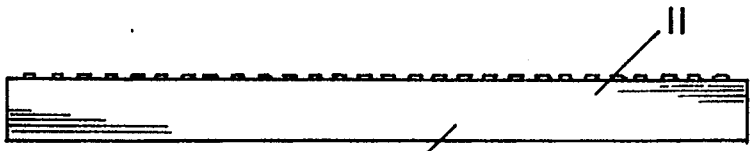
FIG. 4 shows the U-shaped transverse element according to FIG. 3 in a side view.

A support plate for a bridge or ramp having a drive lane according to the present invention is primarily characterized by:

Two longitudinal supports forming lateral sides of the support plate;

A plurality of transverse members arranged parallel to one another and connected between the two longitudinal supports, the transverse members having an upper surface forming the drive lane;

The transverse members being hollow and having a quadrangular cross-section;

The transverse members having a first and a second sidewall, wherein the second sidewalls face the first sidewalls of neighboring ones of the transverse members; and at least one angle member connected to each second sidewall, the angle member having a first leg and a second leg, the first leg resting at and fixedly connected to the second sidewall and the second leg projecting from the second sidewall for support the neighboring transverse member.

Preferably, the thickness of the first leg determines the distance between the neighboring transverse members.

Advantageously, the angle member projects past the second sidewall in a downward direction.

Expediently, 3 to 6 of the angle members are distributed over a length of the second sidewall. Preferably, the angle members are evenly distributed over the length of the second sidewall. Advantageously, the distance between neighboring ones of the angle members is 40 to 80 cm.

In a preferred embodiment of the present invention, the support plate further comprises U-shaped transverse element placed onto at least some of the transverse members, wherein each U-shaped transverse element has a stay and two downwardly oriented legs, the stay having an upper surface with means for increasing slip resistance, and the legs extending between the neighboring ones of the transverse members. Preferably, the length of the U-shaped transverse element corresponds to a distance between neighboring ones of the angle members. Expediently, the downwardly oriented legs are clamped between the neighboring transverse members.

In another preferred embodiment of the present invention, the support plate for a bridge or ramp having a drive lane is primarily characterized by:

Two longitudinal supports forming lateral sides of the support plate;

A plurality of transverse members arranged parallel to one another and connected between the two longitudinal supports, the transverse members having an upper surface forming the drive lane;

The transverse members being hollow and having a quadrangular cross-section;

The transverse members having a first and a second sidewall, wherein the second sidewalls face the first sidewalls of neighboring ones of the transverse member; and The second sidewall having at least one projection for supporting the neighboring transverse member. Preferably, the support plate further comprises U-shaped transverse elements placed onto at least some of the transverse members, wherein each U-shaped transverse element has a stay and two downwardly oriented legs, the stay having an upper surface with means for increasing slip resistance, and the leg extending between the neighboring ones of the transverse members. Preferably, a length of the U-shaped transverse elements corresponds to a distance between neighboring ones of the projections on the second sidewall. Advantageously, the downwardly oriented legs are clamped between the neighboring transverse members.

According to the present invention, at least one of the two sidewalls facing one another is provided with a projection on which the transverse member, respectively, its sidewall is supported. For forming the projections according to the present invention angle members are provided having one leg that is connected to one transverse member, with the adjacent transverse member being supported on the other leg.

The angle members may be in the form of narrow sections of angle irons which are distributed over the length of the transverse member. These angle members are connected before assembling the support plate, respectively the ramp.

The invention furthermore suggests in order to increase the slip resistance of the drive lane another measure which is important especially for slanted ramps. According to the present invention, U-shaped transverse elements are provided on at least some of the transverse members, whereby these U-shaped transverse elements have a profiled stay and downwardly oriented legs that are inserted between neighboring transverse members. The stays of these U-shaped transverse elements can be provided with projections, stamped-out portions, coatings etc. in order to increase grip on the stays.

DESCRIPTION OF PREFERRED EMBODIMENTS

The present invention will now be described in detail with the aid of several specific embodiments utilizing FIGS. 1 through 4.

The ramp on both sides is provided with a longitudinal support 1 having a stay 2 and horizontal legs 3.

Between the stays 2 of the two longitudinal supports 1 transverse members 4 are placed closely adjacent to one another, the transverse members 4 having a rectangular cross-section and being hollow. The upper surface 5 provides the drive lane surface of the ramp. The transverse members 4 extend over the entire width of the drive lane and thus from one longitudinal support 1 to the other, whereby the transverse members are connected to the supports 1 by welding etc.

In order for the transverse members 4 to find additional support when loaded from the top, one of the sidewalls 6 of the transverse members 4 are provided with angle members 7 that are in the form of asymmetrical angle iron sections having a first leg 8 that is connected with the sidewall 6 of the transverse member in a fixed manner, for example, by welding. The other leg 9 extends laterally from the transverse member to form a projection and serves as a support for the neighboring transverse member 4. The angle members 7 are distributed uniformly over the width of the ramp, i.e., the length of the transverse member 4 and are positioned at a distance of approximately 40 to 80 cm spaced from one another. However, the distance depends on the required load carrying capacity.

Figure 2:
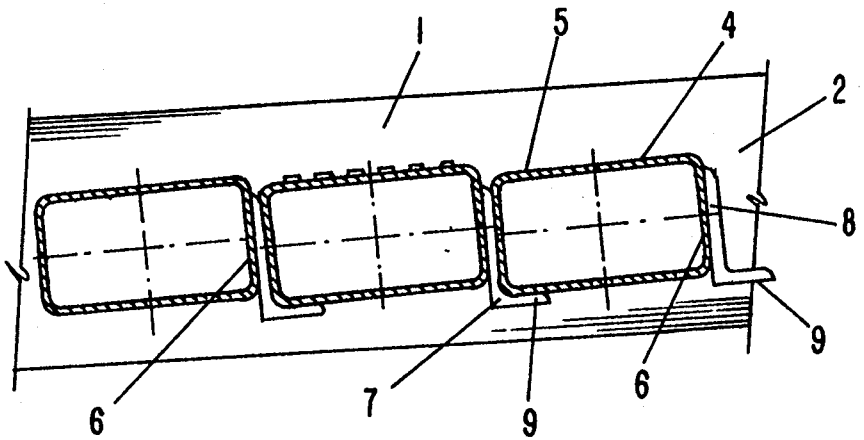
FIG. 2 shows a section along line II—II of FIG. 1.

In FIG. 2 it is shown that the individual transverse members 4 are slightly staggered relative to one another in order to increase the grip by stepping. The angle members 7 are accordingly arranged. FIG. 2 also shows that the wall thickness of the leg 8 corresponds to the distance between the transverse members 4.

This results in the possibility to place the U-shaped transverse elements 11 onto the transverse profiles 4, whereby the stay 10 rests flush on the upper surface 5 and is provided on its outer surface with little projections 12 that improve the slip resistance. The legs 13 of the U-shaped transverse elements 11 extend into the space between neighboring transverse members 4 and can be clamped therebetween. For improved securing of the U-shaped transverse elements 11 the length of the U-shaped transverse elements 11 corresponds to the distance between the angle members 8. Furthermore, the legs 13 can be dimensioned so as to be clamped.

Before assembling the ramp the transverse members 4 are provided with the angle members 7. For the assembly of the ramp only the connection between the longitudinal supports 1 and the transverse members 4 must be perfected.

The present invention is, of course, in no way restricted to the specific disclosure of the specification and drawings, but also encompasses any modifications within the scope of the appended claims.

What I claim is:

1. A support plate for a bridge or ramp having a drive lane, said support plate comprising:

two longitudinal supports forming lateral sides of said support plate;

a plurality of transverse members arranged with a longitudinal extension thereof parallel to one another and connected between said two longitudinal supports, said transverse members having an upper surface forming said drive lane;

said transverse members being hollow and having a quadrangular cross-section;

said transverse members having a first and a second sidewall, wherein said second sidewalls face said first sidewalls of neighboring ones of said transverse members;

at least one angle member connected to each said second sidewall, said angle member having a first leg and a second leg, said angle member having, in a direction of said longitudinal extension of said transverse members, a width that is substantially smaller than said longitudinal extension of said transverse members;

said first leg resting at and fixedly connected to said second sidewall and said second leg projecting from said second sidewall for supporting said neighboring transverse member; and said neighboring transverse member being loosely placed onto said second leg without being mechanically connected to said first and second legs of said at least one angle member.

2. A support plate according to claim 1, wherein a thickness of said first leg determines a distance between said neighboring transverse members.

3. A support plate according to claim 1, wherein said angle member projects past said second sidewall in a downward direction.

4. A support plate according to claim 1, further comprising U-shaped transverse elements placed onto at least some of said transverse members, wherein each said U-shaped transverse element has a stay and two downwardly oriented legs, said stay having an upper surface with means for increasing slip resistance, and said legs extending between said neighboring ones of said transverse members.

5. A support plate according to claim 4, wherein a length of said U-shaped transverse elements corresponds to a distance between neighboring ones of said angle members.

6. A support plate according to claim 4, wherein said downwardly oriented legs are clamped between said neighboring transverse members.

7. A support plate for a bridge or ramp having a drive lane, said support plate comprising:

two longitudinal supports forming lateral sides of said support plate;

a plurality of transverse members arranged parallel to one another and connected between said two longitudinal supports, said transverse members having an upper surface forming said drive lane;

said transverse members being hollow and having a quadrangular cross-section;

said transverse members having a first and a second sidewall, wherein said second sidewalls face said first sidewalls of neighboring ones of said transverse members;

at least one angle member connected to each said second sidewall, said angle member having a first leg and a second leg, said first leg resting at and fixedly connected to said second sidewall and said second leg projecting from said second sidewall for supporting said neighboring transverse member; and wherein 3 to 6 of said angle members are distributed over a length of said second sidewall.

8. A support plate according to claim 7, wherein said angle members are evenly distributed over said length of said second sidewall.

9. A support plate according to claim 7, wherein a distance between neighboring ones of said angle members is 40 to 80 cm.

10. A support plate for a bridge or ramp having a drive lane, said support plate comprising:

two longitudinal supports forming lateral sides of said support plate;

a plurality of transverse members arranged with a longitudinal extension thereof parallel to one another and connected between said two longitudinal supports, said transverse members having an upper surface forming said drive lane;

said transverse members being hollow and having a quadrangular cross-section with a first and a second sidewall and a bottom surface, wherein said second sidewalls face said first sidewalls of neighboring ones of said transverse members;

said second sidewall having at least one projection for supporting said neighboring transverse member, said projection having, in said longitudinal direction of said transverse members, a width that is substantially smaller than said longitudinal extension of said transverse members; and said bottom surface of said neighboring transverse members being loosely placed onto said projection without being mechanically connected to said projection.

11. A support plate according to claim 10, further comprising U-shaped transverse elements placed onto at least some of said transverse members, wherein each said U-shaped transverse element has a stay and two downwardly oriented legs, said stay having an upper surface with means for increasing slip resistance, and said legs extending between said neighboring ones of said transverse members.

12. A support plate according to claim 11, wherein a length of said U-shaped transverse elements corresponds to a distance between neighboring ones of said projections on said second sidewall.

13. A support plate according to claim 11, wherein said downwardly oriented legs are clamped between said neighboring transverse members.

* * * * *